United States Patent [19]

Remeyer

[11] 4,443,900

[45] Apr. 24, 1984

[54] HYDROTHERAPY TANK

[76] Inventor: Willijan P. Remeyer, 11791 Loara St., Suite B, Garden Grove, Calif. 92640

[21] Appl. No.: 445,087

[22] Filed: Feb. 3, 1983

[51] Int. Cl.[3] ..... E04H 3/16; E04H 3/18; A61H 33/02

[52] U.S. Cl. ..... 4/492; 4/488; 4/507; 4/541; 4/542

[58] Field of Search ..... 4/541, 542, 543, 544, 4/492, 488, 489, 490, 506, 559, 509, 507, 508, 487; D24/38; 128/66; 52/169.7, 742; 210/169

[56] References Cited

U.S. PATENT DOCUMENTS

| | | | |
|---|---|---|---|
| D. 254,447 | 3/1980 | Reineman | D24/38 |
| 3,693,194 | 9/1972 | Schindler et al. | 4/492 |
| 3,943,580 | 3/1976 | Carter | 4/492 |
| 4,126,905 | 11/1978 | Russell et al. | 4/489 |
| 4,142,337 | 3/1979 | Holcomb | 4/492 X |
| 4,149,281 | 4/1979 | Bob et al. | 4/542 X |
| 4,213,210 | 7/1980 | Scourtes | 4/543 |
| 4,233,694 | 11/1980 | Janosko et al. | 4/542 |
| 4,238,859 | 12/1980 | Badon, Jr. | 4/492 X |
| 4,339,833 | 7/1982 | Mandell | 4/542 |
| 4,414,695 | 11/1983 | Hart | 4/559 X |

*Primary Examiner*—Henry K. Artis

[57] ABSTRACT

A hydrotherapeutic massage structure comprising a large volume, upwardly opening water-filled container with at least one substantially vertical side, a small volume, elongate, vertically extending upwardly opening water-filled tank with substantially vertical sides and positioned adjacent said one side of the container, an elongate, vertical gate opening between the container and gate, a plurality of water jet and air aspirator nozzles carried by the side wall of the tank in circumferential and vertical spaced relationship about and disposed radially inwardly toward the central vertical axis of the tank, air supply means connected with the nozzles and water recirculating means drawing water from the container and delivering it at high pressure to the nozzles. The tank is slightly greater in diametric extent than the major diametric extent of a person standing substantially upright at the center of the tank and is substantially equal in vertical extent with the shoulder height of the person. The gate opening is sufficiently wide to allow a person to move substantially freely between the container and the tank and is of sufficient volumetric flow capacity to allow aerated water introduced into the tank by the nozzles to flood into the container.

11 Claims, 7 Drawing Figures

HYDROTHERAPY TANK

This invention has to do with a novel hydrotherapeutic massage structure.

BACKGROUND OF THE INVENTION

In the art of health care, it is well recognized that warm or hot water baths have great therapeutic value.

Hydrotherapy, that is, the treatment of disease or trauma by external use of water has long been practiced. With the ever-increasing ability to provide and/or deliver hydrotherapeutic treatments and/or services, the practice of hydrotherapy has, in recent years, been increasing at a notable rate. While the use of common domestic bathtubs afford limited therapeutic treatment for persons who can be effectively treated while lying down in a physically confined condition in a shallow body of hot or warm water, for short periods of time and who are physically capable of safely and comfortably moving or climbing into and out of such tubs, they are of limited or questionable value for the treatment and care of persons who, due to a weakened condition or trauma, cannot safely climb into and out of such tubs and cannot or should not be made to lie down in shallow bodies of water in physically restrained conditions. Such common bathtubs are totally inadequate for therapeutic use in those situations where the hydrotherapy to be effected requires that the person being treated be buoyantly supported to a substantial extent, while in a substantial upright standing or seated positions; where the person's body and/or limbs are to be moved and exercised during and as part of the therapy; and where the treatments require that the temperature of the water be maintained at relatively high and constant temperatures for protracted periods of time.

As a result of the above, in the past, when hydrotherapy was prescribed, for the ailing or inferm, it was necessary for those being treated to be admitted into and to travel to and from those hospitals and similar medical facilities where large hydrotherapy tanks are provided. As a general rule, such hydrotherapy tanks are simple, floor-supported metal tanks from 3½' to 4' deep and from 6' to 8' in diameter. The water in such tanks is sufficiently deep to enable persons to be treated therein to gain substantial buoyant support and are sufficiently wide or extensive to enable persons treated to move about and to engage in prescribed exercise. The above noted hydrotherapy tanks generally require ladders or hoists to enable the persons to be treated to get into and out of the tanks or to be placed in and removed therefrom. Further, it is generally required that chairs or seats be placed in such tanks when the persons being treated must sit and/or rest while in the tanks. Still further, as a general rule, the persons treated in such tanks must be accompanied and their treatment must be supervised by a physical therapist or one whose primary job is to see that the persons being treated get safely into and out of the tanks and do not drown when in the tanks.

The large volume of hot water in such tanks and the hot water supply and drain means for such tanks is generally such that the temperature of the water therein can be effectively adjusted and controlled for effecting most prescribed treatments.

As the art of hydrotherapy developed, it was found that hydrotherapeutic treatments are frequently greatly enhanced by vigorous turbulation of the water which stimulates circulation. Such stimulation of circulation is further enhanced by directing high pressure jets of water onto the bodies of persons being treated. Such jets of water effect deep working or massaging of the bodies' tissues and joints in a similar yet more effective and gentle manner than can be attained by manual massage.

To the above end, hydrotherapy tanks of the general character referred to above are commonly equipped with electric driven submersible pumps engageable in the tanks and provided with water outlet nozzles which can be moved about and directed onto patients being treated, to massage the patients, as desired or as circumstances require.

Due to the great inconveniences and excessive high costs of obtaining hydrotherapeutic treatment in hospitals and the like, and due to the well recognized physical benefits afforded by hydrotherapy, a want and need for hydrotherapy tanks such as are used in hospitals and the like, for regular domestic use, has been recognized. That need and want has led to the development of and has been satisfied by those hydrotherapy tank-like structures which are commonly called "hot tubs" or "spas".

In recent years, the manufacture and sale of hot tubs has grown at a rapid rate and has brought about a development of new and improved hot tub structures and related support systems and/or equipment.

With few possible exceptions, hot tubs for domestic use are notably more decorative and aesthetically pleasing than hydrotherapy tanks such as are found in hospitals and the like and, with few exceptions, have been enhanced with varying and different designs and equipment changes which render them safer, easier to use and generally more effective and efficient than many hydrotherapy tanks found and used in hospitals and the like.

As a result of competition, the cost of hot tubs is such that when a physician prescribes hydrotherapy treatments for a patient, which treatments must be given to the patient regularly for a protracted period of several months, it is more convenient and far more economical for the patient to purchase, maintain and to operate a hot tub at his or her home than it would be to receive treatment as an in-patient or out-patient at a hospital or similar institution. As a result of the foregoing, many private insurance companies and in many instances, government sponsored medical insurance plans, cover and/or pay for the cost of hot tubs when such appears to be economically prudent.

Further, when the purchase of a hot tub is prescribed by a taxpayer's physician, the cost of such a tub is a proper tax deduction.

The foregoing history of the development and state of the art of hot tubs is significant since it makes clear the fact that hot tubs are valuable and important therapeutic devices or equipment and while popular and enjoyed by many persons as a simple luxury they are not mere play equipment.

A major shortcoming found in those hospital hydrotherapy tanks and in those hot tubs provided by the prior art resides in the placement and control of those pumps and jets which are provided to effect hydro-massage. In the case of hyderotherapy tanks, submersible pumps are commonly removably engaged in the tanks and the pumps are provided with discharge nozzles which can be directed onto persons immersed in the tanks for treatment, as desired. In the case of domestic hot tubs, when such tubs are provided with hydro-massage means, one or more jets are positioned at the walls of the tubs at predetermined positions so that persons can move about and position themselves in the tubs and relative to the nozzles to receive desired massage. In the case of hot tubs, the jets receive water from the outlets of pumps which are located outside the tubs and the inlets of which are connected with drains at the bottoms of the tubs. In practice, due to the limited range and rapidly diminishing force effect of water jets in substantially static bodies of water, the effective range of the water jets of hydro-massage means in hot tubs is extremely limited and is often such that the effectiveness of many such means is of little practical use. An effective range of four to six inches can be anticipated.

In the more sophisticated and highly developed hydro-massage means for hot tubs and the like, air is introduced into the volume of water in the tubs adjacent the nozzles and along with the jets of water to lighten the load of the water in the tanks which reacts with and tends to buffer the jets of water. In most instances, the water nozzles are incorporated in aspirator units which are connected with suitable air supplies whereby the jets of water draw and carry with them appropriate volumes of air to attain the desired end effect. With such air assisted hydro-massage means, the effective range of the water jets is materially increased but nonetheless remains quite limited.

In the case of the above noted air assisted hydro-massage means, the amount of air that can be introduced into the tubs and the extent to which the water in the tubs can be lightened thereby is limited. If an excessive amount of air is introduced into the water in the tubs, the water is likely to be aerated and lightened to such an extent that it will afford insufficient buoyant support for persons in the tubs and tends to so aerate and increase the volume of water that it will cause the tanks to overflow and the water to be blown therefrom. As a result of the foregoing, it has been established that in practice, the most practical and effective range of the water jets in air assisted type hydro-massage means is from eight to twelve inches.

It is to be noted that the above discussion concerning the effective range of the jets of water in hydro-massage means for hot tubs is based upon a maximum safe and practical volume, pressure and flow rate for hydro-massage jets. When attempts are made to increase the pressure and the rate of flow at the nozzles, the force of the jets at the nozzles could become excessive and create an unreasonable risk of harm.

Due to the spaced relationship and the limited effective range of water jets directed into hot tubs by hydro-massage means incorporated in such tubs, it will be apparent that to be effectively massaged by the water jets, a person must move about the tub and into close proximity with an appropriate nozzle and must turn or twist about and raise or lower his body to some extent in order to have the jet of water issuing from that nozzle, impinge upon and massage a desired portion of his body. If and when he wants another portion of his body massaged, he must change position and maneuver about and into the effective range of another water jet. While such moving and maneuvering about in a hot tub, to be massaged, is a nuisance, inconvenient and oftentimes impractical, it is looked upon as an inherent characteristic of hot tubs and has become accepted by most owners and users of hot tubs.

OBJECTS AND FEATURES OF THE INVENTION

An object of my invention is to provide a novel hydro-massage means for hot tubs, hydrotherapy tanks, swimming pools and the like, which means is such that it will effectively hydrotherapeutically work upon all desired parts and portions of a person's body while the person is buoyantly supported in a substantially upright position in a confined volume of water.

It is an object and feature of my invention to provide a novel hydro-massage means of the character referred to above which includes a plurality of vertically and circumferentially spaced radially inwardly disposed nozzles in limited predetermined radial spaced relationship from a common central vertical axis within a contained volume of water, the radial distance of the nozzles from said axis being preferably no less and no more than six inches greater than the maximum effective massaging range of the jets of water issuing from the nozzles, whereby the surface of a person's body, when standing at the vertical axis of the volume of water are in close proximity to the most effective working range of each jet of water.

Another object of my invention is to provide a hydro-massage means of the general character referred to above wherein the several nozzles are spaced vertically so that the several jets issuing therefrom converge along the vertical axis of the volume of water.

Still another object of my invention is to provide a hydro-massage means of the general character referred to above wherein the several nozzles are spaced circumferentially about said axis so that the jets of water issuing therefrom effectively work throughout a full 360° of the central vertical axis of the volume of water as they diverge radially inwardly along their directed axes.

Still another object and feature of my invention is to provide a novel means of the general character referred to above wherein the contained volume of water and the nozzles are contained and carried by a wall structure spaced radially outward from and extending at least 180° about the central vertical axis of the means.

Still another object and feature of this invention is to provide a hydro-massage means of the general character referred to above wherein said wall about a portion of the central vertical axis of said means and which carries the nozzles, defines a vertical gate establishing communication between the water occupied space defined by that wall and an adjacent confined body of water and through which a person can freely move. The gate is such that large volumes of water can move through it, whereby the volume of water within the massage means, when vigorously turbulated and expanded by the introduction of water and air, is free to move through the gate and into the adjacent body of water and is not subject to overflowing and being blown out of the open top of said means.

It is an object and feature of the present invention to provide a hydro-massage means of the general character referred to which can be cooperatively related with a swimming pool, hydrotherapy tank or hot tub and which is such that a person can freely move through the gate and into and out of position in said means and said pool tank or tub, while buoyantly supported in a substantially upright position.

An object and feature of this invention is to provide a hydro-massage means of the character referred to including structure which can be easily and effectively built into a related swimming pool and/or hot tub structure built to depend below or project above the surface of the ground.

Finally, it is an object and feature of my invention to provide a means of the character referred to which includes novel means to move and deliver water and air to the nozzles.

The foregoing and other objects and features of my invention will be fully understood and will be apparent from the following detailed description of one typical preferred forms and embodiments of my invention, throughout which description reference is made to the accompanying drawings.

DESCRIPTION OF THE DRAWINGS

FIG. 7 is a diagrammatic view of the water supply heating and recirculating system.

DETAILED DESCRIPTION OF THE INVENTION

Figure 1:
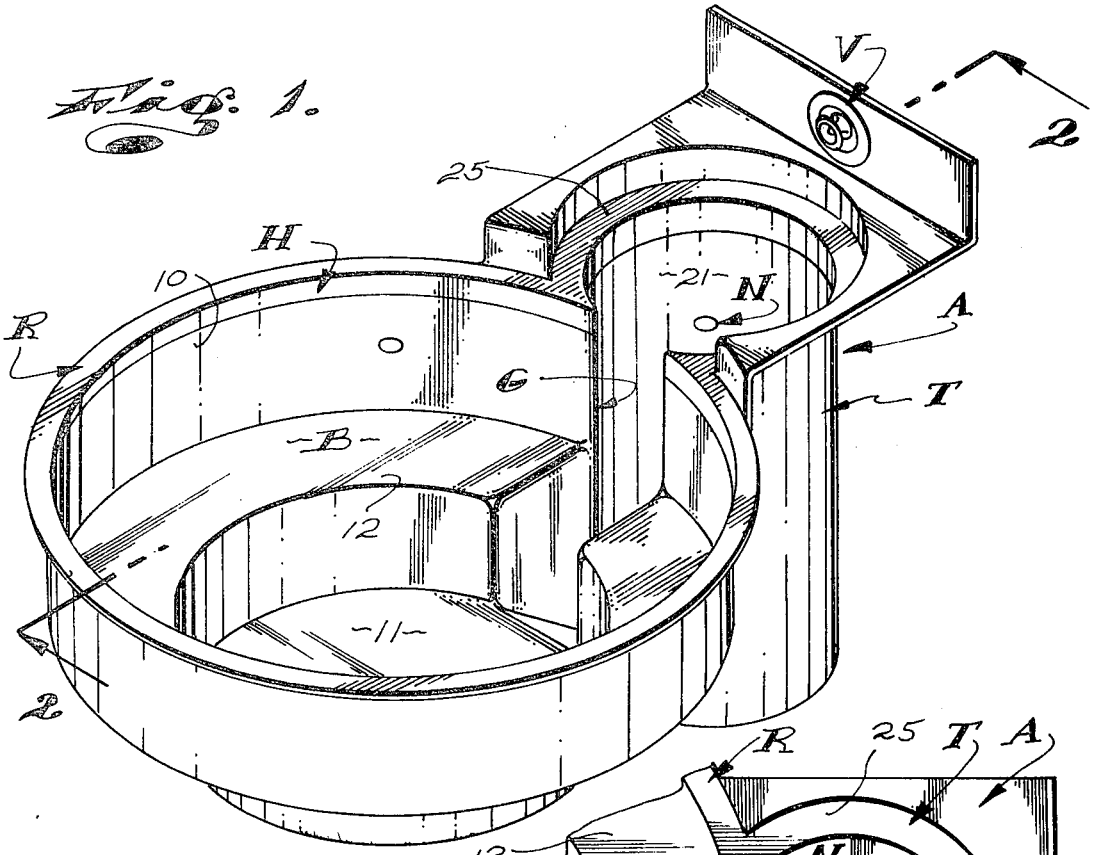
FIG. 1 is an isometric view of a hot tub with my novel hydro-massage structure related to it.
Figure 3:
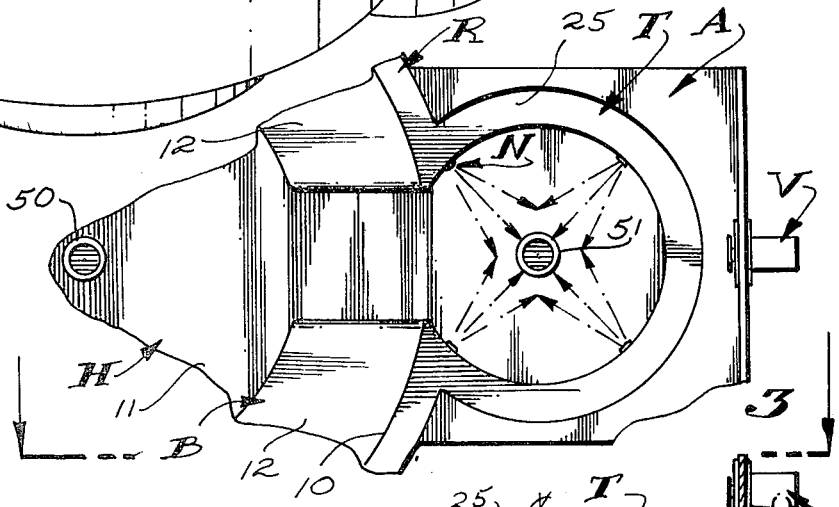
FIG. 3 is a plan view of a portion of the structure shown in FIGS. 1 and 2 and taken substantially by line 3—3 on FIG. 2.
Figure 2:
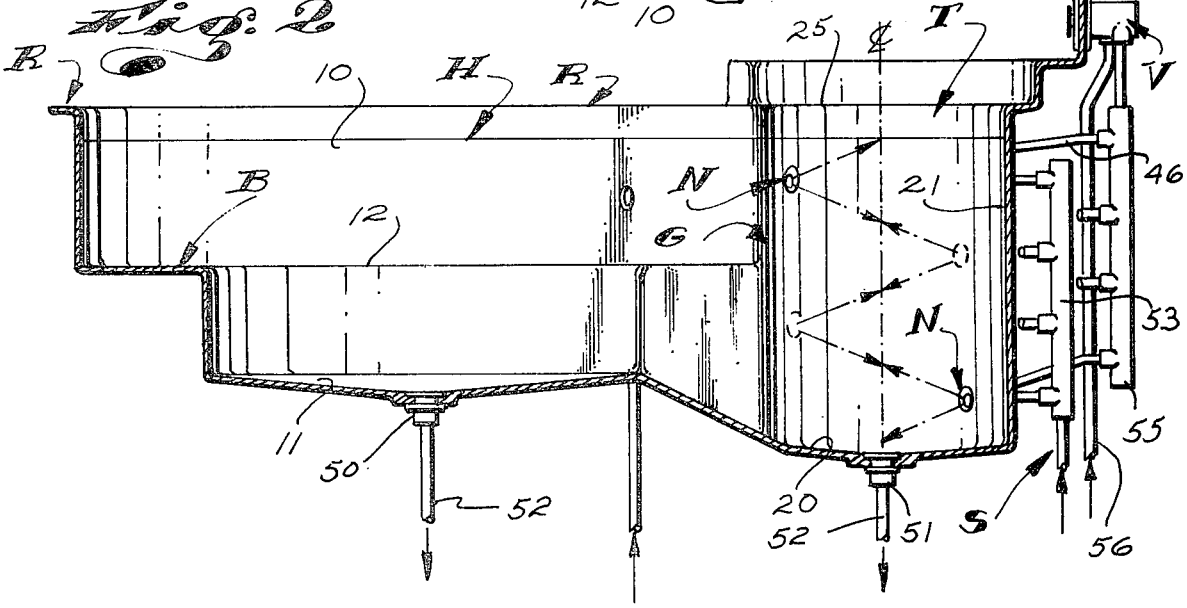
FIG. 2 is a sectional view taken substantially as indicated by line 2—2 on FIG. 1.

For the purpose of this disclosure, I have elected to show my new therapeutic massage structure A related to a typical hot tub structure H of that type or class which is molded of fiberglass and resin and which can be mounted and supported on the surface of the ground or other suitable deck or the like, to project upwardly therefrom or which can be buried or lowered into the ground or other supporting structure in a "sunken" condition with its open top at or near the surface of the ground or its related supporting structure.

It is to be understood and it will be apparent that in practice, the means A can be effectively related to a swimming pool, a hydrotherapy tank or other container for large volumes of water in which persons can freely immerse themselves. It will be further apparent that the means A can be specially fabricated or built into any swimming pool, hot tub or the like, using whatever materials are appropriate and suitable for its construction.

In the case illustrated, the hot tub is a simple, elongate, vertically extending and upwardly opening tank with a cylindrical vertical side wall 10 and substantially horiztonal bottom wall 11. In accordance with common practice, and built into and extending between the side and bottom walls 10 and 11 is a semi-circular bench structure B projecting radially inward from the side wall 10 and upwardly from the bottom wall 11 and defining an upper horizontal seating surface 12, spaced vertically between the open top of the tub and the bottom thereof.

The hot tub H is sufficiently large in diameter so that two or more persons can comfortably arrange themselves in seated position on and about the seating surface 12 therein. Such tubs are commonly between 7' and 10' in diameter. The vertical extent of such tubs is generally slightly greater than 3'6" so that the full usable or functional depth of a volume of water contained therein is about 3'6". The benches or equivalent seating structure in such tubs are generally such that the seating surfaces thereof are about 18" below the surface of the water and project out from the side walls of the tubs about 18".

The upper edge of the side walls 10 is provided with an upwardly and outwardly extending rim R to reduce spilling of water from within the tubs and for obvious aesthetic purposes.

The size, shape and construction of the tub H has little or no effect on my invention and to the best of my knowledge and belief, my invention can be related to or incorporated into substantially any conventional type of hot tub, swimming pool or water containing vessel or tank without adversely affecting the invention. In practice, it is only required that the tub, pool or tank with which my invention is related have at least one side wall structure suitably disposed and of sufficient vertical extent to enable the means A that I provide to be effectively related to it.

The hydro-massage means A includes an elongate, vertically extending water contining vessel or tank T with a substantially horizontal bottom wall 20, a vertical side wall 21, an open top and one open side defining a vertically extending gate G to establish open communication between or connect the tank and the hot tub H. The tank T is shown as being cylindrical in plan configuration though it might be ovoid or polygonal in plan configuration without departing from the spirit of my invention. The tank T can vary substantially in vertical extent and must be such that when a person stands substantially upright on the bottom wall 20 thereof, the normal water level in the tank is about shoulder height. It has been determined that in practice, if the vertical extent of the tank is such that the normal depth of the water therein is about 4'6", the structure A can be advantageously used and will effectively work upon most adults. For persons of substantially greater than normal height, for example, 6'3" or more, a structure A of greater than normal vertical extent might be required. For persons who are shorter than average, for example, less than 5' tall, substantially any pedestal structure can be placed on the bottom wall 20 or a step, such as shown at 20' in FIG. 5 of the drawings, can be built into the bottom of the tank, upon which such short persons can stand to increase their effective height within the tank. Alternatively, in the case of short persons, the water level in the tank and its related tub H can be lowered to a suitable level.

In the preferred carrying out of my invention, the tank T is such that its vertical side wall 21 is spaced the same distance from the central vertical axis of the tank at or along four vertically and radially right angularly related planes in the tank. That is, four portions of the side wall 21 of the tank, spaced 90° from each other, are spaced equal distances radially outward from the central vertical axis of the tank. Such equal spacing of the noted four portions of the side wall 21 relative to the central vertical axis of the tank enables the placement of at least four circumferentially spaced radially inwardly disposed water nozzles N in or at the wall 21 of the tank, equal distances from the central vertical axis thereof.

The radial distance of the nozzles N from the central vertical axis of the tank is determined by the maximum effective range of the jets of water (and air) issuing from the nozzles.

The maximum effective range of the jets of water issuing from the nozzles N therefrom is determined by a number of variables and can vary considerably. The phrase "maximum effective range", as used herein, is that distance from each nozzle N where the jet of water issuing therefrom retains sufficient working force so that when it impinges upon a person's body, it will transmit sufficient working energy into the person's body to effectively massage his body. While what is or might consitute "effective force" or "work energy" is subject to conjecture and cannot be established with great certainty, the range of effectiveness of such jets of water (and air) directed into and through a volume of static water is, in practice, a rather narrow range and is readily established by imperical testing and adjusting of the size of the nozzles, the water pressure and the air supply. The range or distance from a nozzle where a jet of water (and air) issuing therefrom affords insufficient effective force to massage one's body is readily determinable. Excessive force within a jet of water (and air) is any force which is so great that it is likely to cause substantial physical discomfort and/or injury to a person upon which it impinges and must be measured or tested at or in close proximity to the outlet of the nozzle. Accordingly, the maximum force that can be imparted into a jet of water (and air) must be measured and limited at the nozzle, independent of the effective range of the jet of water (and air) for massage purposes is clearly limited and is readily determinable.

In practice, the maximum effective range of a jet of water (and air) in a hydro-massage means, is determined and/or controlled by the volume and pressure of the water jet, the volume of air that is carried by or combined with the water jet, and the extent to which the volume of water into which the jet is aerated (lightened). The maximum extent to which the body of water can be aerated and the maximum amount of air that can be effectively combined with the jet of water are subject to inherent and practical limitations.

In practice, the most practical and effective manner to increase or decrease the maximum effective range of a jet of water (and air) in a hydro-massage means is to increase or decrease the volume of water in the water jet by increasing or decreasing the diameter of the water nozzle and increasing or decreasing the volume and pressure of the water supplied to the nozzle, as by increasing or decreasing the capacity of its related water recirculating means. By increasing or decreasing the volume and mass of the water jet, its effective range can be adjusted while maintaining its maximum force, at the nozzle, at a safe level.

In accordance with the foregoing, while the phrase "maximum effective range" to describe the nature and character of the jets of water (and air) does not provide a specific distance or measurement, it fairly limits and properly defines those ranges or distances which are readily determinable in each embodiment of my invention by imperical testing and adjustment and ranges or distances which are limited and substantially certain. In practice, the volume and flow rate of water jets issuing from the nozzles in hydro-massage means is fixed and the effective range of the jets (to effect massage) is varied by varying the amount or volume of air that is introduced with the jets of water to lighten or reduce the load and resistance of the static volume of water into which the jets are directed and which tends to slow and diffuse the jets of water and limit their effective range. Accordingly, the maximum effective range of the jets of water (and air) is that range where the maximum effective volume of air is introduced or added and reduced effective ranges are attainable by reducing the volume of air.

In furtherance of my invention, when, for example, the maximum effective range of the jets of water and air is 15", the radial spacing of the nozzles N and their related portions of the wall 21 of the tank, from the central vertical axis of the tank, is 15", whereby the full and maximum massaging work that can be performed by the jets extends to the center of the tank and will extend well into the bodies of persons standing substantially upright in the center of the tank.

In operation, the jets of water and air expand radially outward (about their axes) in the static volume of water in the tank as they move radially inward in the tank. The diverging angle of the expanding jets is not readily determinable but is observed to be from between 30° and 40° and is such that if four nozzles N are positioned 90° apart on a common horizontal plane, 15" from the central vertical axis of the tank, and a person of average size and bulk stands in the center of the tank with a portion of his body extending vertically through the noted plane of the tank, the four jets would workingly impinge upon a full 360° or all surfaces of that portion of the person's body, within the effective working plane of the jets.

In accordance with the above, my invention provides a structure where a plurality (four or more) of nozzles N are spaced circumferentially in the tank T. The four nozzles are spaced radially outward from the central axis of the tank a sufficient distance so that when a person of average size and bulk is standing in the center of the tank, all sides of his body, throughout a full 360° thereof, is workingly engaged by the jets of water issuing from the nozzles.

In furtherance of my invention, and so that the several noted jets will effectively work upon and massage a person standing centrally in the tank T throughout the major vertical extent of his body, the several nozzles are spaced vertically relative to each other and so that the radially inwardly diverging jets collectively impinge the person's body, substantially uninterruptedly, throughout the full normal depth of the tank T.

In accordance with the above, if the tank is 56" deep and there are four nozzles N (as noted above), the uppermost and lowermost nozzles are positioned 7" below and above the top surface and bottom of the water and the two intermediate nozzles are spaced 14" vertically relative to each other and to their related top and bottom nozzles. With such a relationship of nozzles, the jets will impinge, uninterruptedly, upon the body of a person standing centrally within the tank, from the bottom to the top surface of the water therein.

With the structure illustrated and described above, it will be apparent that a person standing centrally in the tank can have all surfaces and portions of his body hydraulically massaged by the jets of water issuing from the several nozzles by slowly or intermittently turning his body through about 270° within the tank.

Figure 4:
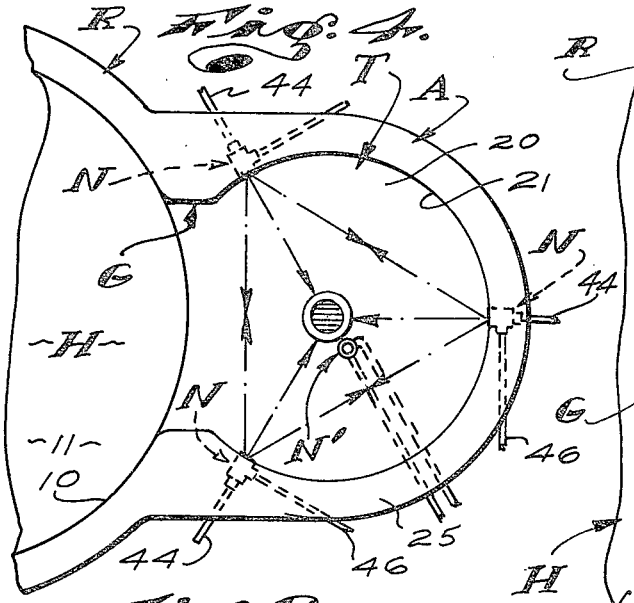
FIGS. 4 and 5 are diagrammatic plan views of other embodiments of the invention.

While it is preferred that four nozzles N, on four radial vertical planes spaced 90° in the tank be provided, effective and acceptable results can be attained with but three nozzles on three vertical radial planes spaced 120° apart in a related tank, as shown in FIG. 4 of the drawings. Such a reduced number of nozzles has proven to be effective in tanks which are from 3' to 3½' in diameter and which are equipped with large volume nozzles that deliver jets which are effective to from 18" to 20".

In the preferred carrying out of my invention, it is desirable to maintain the tanks T as small in diameter as is possible so that a person moving into and standing in the tank can comfortably raise and engage his or her arms and elbows into engagement on a horizontal flange-like arm-rest 25 provided about the upper rim of the tank, as clearly shown in the drawings. Such an arm-rest is extremely comfortable and affords great security for persons standing in the tank during operation and use thereof. In the case of tanks greater than 3' in diameter, the security and safety afforded by such an arm-rest is greatly reduced.

When in use, the air introduced into the tank T with the jets of water and the turbulence generated in the water expands the effective volume of the water to such an extent that if the gate G that I provide was not provided, it would blow upwardly and out through the open top thereof. Accordingly, the hot tub H or an equivalent water containing structure and the gate G which allows for expansion of water in the tank T into the tub H are necessary and important elements of my invention.

In addition to the function noted above, the gate G permits a person to move into and out of engagement in the tank T by first moving into engagement in the tub H and thence simply walking into and out of the tank T, through the gate. Due to the small size of the tank T, if the gate G was not provided, the most agile of persons would find it difficult to enter and exit the tank T and a great number of people would find it impossible to do so.

In the form of the invention illustrated, since the tank T is greater in depth than the hot tub H, I provide an inclined ramp 30 extending between and joined with the bottom wall 10 of the hot tub and the bottom wall 20 of the tank. The ramp is coextensive with that portion of the gate which extends through the bench structure in the hot tub. If the hot tub did not include the noted bench structure and the bottom wall of the hot tub extended to the side wall of the tank, one moving through the gate, from the tub into the tank would have to step down into the tank.

Should the structure A that I provide be related to a side wall of a swimming pool which is greater in depth than the tank T, a person in the pool and moving through the gate and into the tank T might have to swim to the gate or might have to step up through the gate and into the tank T.

Figure 6:
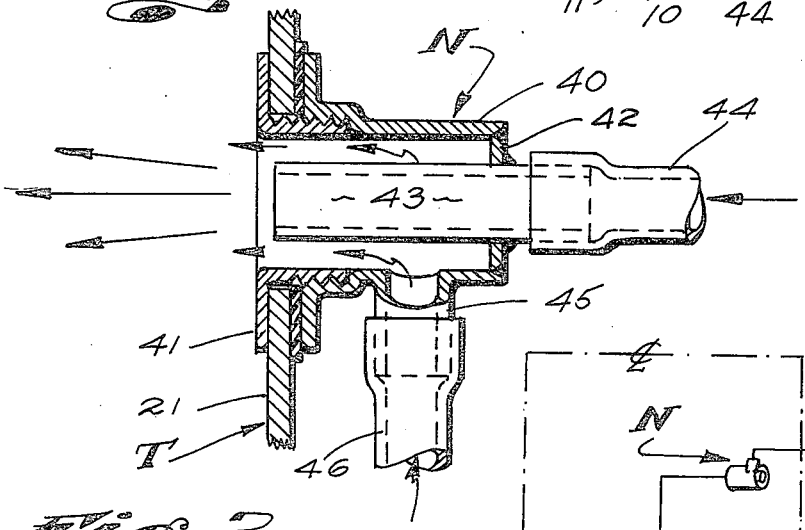
FIG. 6 is an enlarged detailed sectional view of a nozzle structure.
Figure 2:
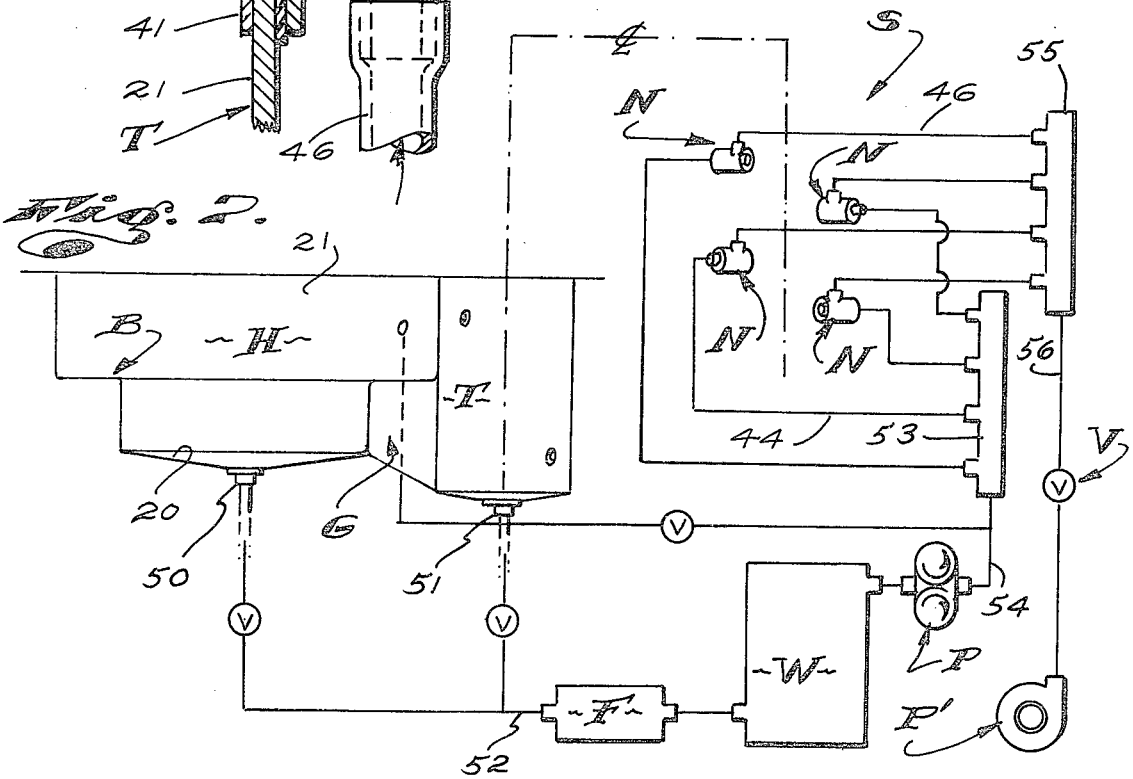

In FIG. 6 of the drawings, I have shown a typical nozzle structure N suitable for use in carrying out my invention. The nozzle N is an aspirator unit with an elongate radially extending tubular body 40 with inner and outer ends. The inner end of the body has a mounting flange means 41 to facilitate mounting the nozzle in the wall 21 of the tank. The rear end of the body is closed by an apertured wall 42. The water nozzle consists of a tube 43 engaged through the wall 42 and extending freely through the body 40 to terminate adjacent the inner open end of the body. The rear or outer end of the water nozzle or tube 43 connects with a water delivery line 44. The body 40 has a radially opening air inlet nipple 45 at its rear end portion, rearward of the forward open ends of the nozzle 43 and body 40 and with which an air supply line 46 is engaged.

Figure 5:
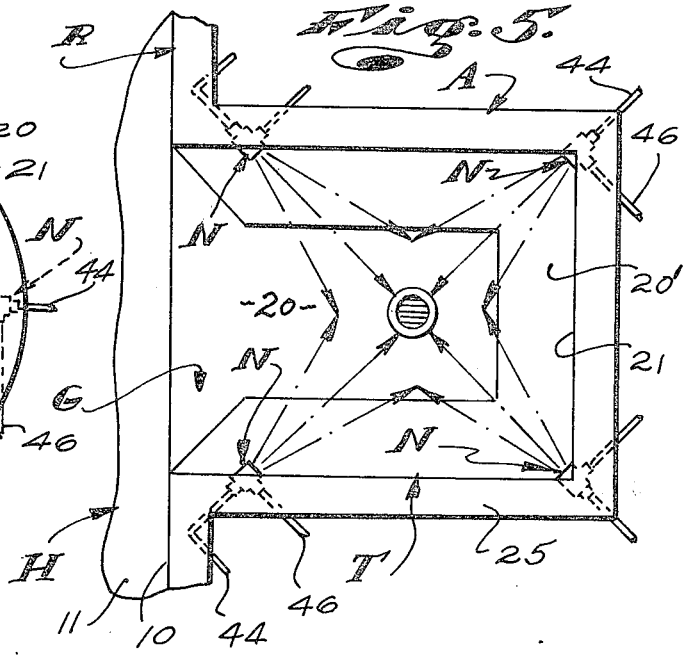

With the nozzle structure set forth above and illustrated in FIG. 5 of the drawings, it will be apparent that water issuing from the nozzle 43 and thence out through the radially inwardly disposed open end of the body 40 creates a minus pressure in the body, rearward of the inner open end of the nozzle 43. The minus pressure thus established in the body 40 draws air through the line 46, nipple 45 and into the body 40, which air is carried by the jet of water out of the body 40 and into the tank T, as circumstances require.

In FIG. 7 of the drawings, I have diagrammatically illustrated one typical and suitable form of support system S for the hydrotherapeutic massage means A that I provide.

The support system S is shown as including a water heater unit W with upstream and downstream sides. The upstream side of the heater unit W is connected with the drain fittings 50 and 51 of the hot tub H and tank T by means of a drain line 52. The system S next includes a water pump P with upstream and downstream sides. The upstream side of the pump P is connected with the downstream side of the water heater unit W. The downstream side of the pump P is connected with a water manifold or log 53 by a line 54. The log 53 is connected with each of the tubes 43 of the nozzles N by delivery lines 44.

With the means S thus far described, it will be apparent that water is drawn from the tub H and tank T, heated by the heater W and returned to the tank T, through the nozzles N, by the pump P.

The system S next includes an air pump P' with an air inlet communicating with the ambient atmosphere and an outlet connected with an air manifold or log 55, by a line 56. A manually adjustable air metering valve V is engaged in the line 56. The manifold is connected with the inlet fittings on the bodies of the nozzles N by delivery lines 46. With the foregoing portion of the system S, it will be apparent that an adequate or ample supply of air for the nozzles N is provided for and that the flow of air to and through the nozzles can be effectively controlled.

Though the air supply means might function without the air pump, there is a tendency for water within the tank T to flow into and to flood the nozzles N and their related air lines. Should this happen, desired functioning of the nozzles would be adversely affected. With the air pump P, air under sufficient pressure to purge the air handling portion of the system S is provided and desired and effective operation of the entire system is assured.

In accordance with common practice, a filter F can be engaged in the system S downstream of the heater W.

In practice, and as shown at N' in FIG. 4 of the drawings, one or more upwardly directed nozzles can be positioned at the bottom wall 21 of the tank to massage the user's feet and ankles in a most effective manner.

In the preferred form of my invention, and as shown in the drawings, I provide an upwardly projecting weir about the arm rest 25 to contain and direct water that might surge upwardly and out of the tank back into the tank and/or into the hot tub.

Further, as shown in the drawings, a decorative control panel can be provided adjacent one side of the tank T for convenient mounting of the valve V and other controls that might be required.

Having described only typical preferred forms and embodiments of my invention, I do not wish to be limited to the specific details herein set forth but wish to reserve to myself any modifications and/or variations that might appear to those skilled in the art and which fall within the scope of the following claims:

Having described my invention, I claim:

1. In combination, a water container with a substantially horizontal bottom, sides extending substantially upwardly from the bottom and an open top, said container is of sufficient depth and plane area to accommodate and substantially buoyantly support a plurality of people when filled with water; and a hydrotherapeutic massage structure comprising an elongate vertical tank outward of and adjacent to a side of the container and having a substantially horizontal bottom, verical sides and an open top on a plane close to the plane of the open top of the container, an elongate vertical and laterally opening gate substantially coextensive with the vertical extent of the tank establishing communication between the container and the tank and through which one person in the container can move substantially freely into said tank in a substantially upright position, a volume of water in and filling the container, gate and tank to a filled water level near the open tops thereof, the depth of water in the tank is substantially equal to the mean shoulder height of persons for whom the tank is established for use, the sides of the tank extend at least 180° about the central vertical axis of the tank, the gate and the sides of the tank are spaced radially outward from the central vertical axis of the tank a distance greater than the mean radial extent and less than three times the mean radial extent of persons for whom the tank is established for use when such a person is standing substantially upright centrally in the tank, a plurality of nozzles mounted at the sides of the tank in circumferential, radial and vertical spaced relationship about and disposed substantially radially inwardly toward the central vertical axis of the tank, at least one nozzle is positioned in close proximity to and is angularly disposed away from said gate and water recirculating means moving water from the container and the tank and delivering water to the nozzles at high pressure.

2. The combination set forth in claim 1 wherein the nozzles direct water jets into the volume of water in the tank, said jets of water diverge radially inwardly along their directed axes and a combination wherein the nozzles are spaced radially outward from the central axis of the tank so that the diverging jets of water impinge upon the radially disposed sides of a person standing centrally in the tank.

3. The combination set forth in claim 1 which further includes air supply means and nozzles to introduce air into the tank with the jets of water to aerate and lighten the water in the tank to extend the maximum effective working range of the jets of water radially into the tank.

4. The combination set forth in claim 1 which further includes air supply means and wherein said nozzles are aspirator nozzles with water conducting parts connected with the water recirculating means to issue jets of water and air conducting parts connected with the air supply means and through which air is drawn by the jets of water.

5. The combination set forth in claim 1 wherein the tank has an outwardly projecting horizontal arm-rest about its open top.

6. The combination set forth in claim 1 wherein the tank has an outwardly projecting substantially horizontal arm-rest about its open top and an upwardly projecting weir about the outer perimeter of the arm-rest.

7. A hydrotherapeutic massage structure comprising an elongate vertical tank with a substantially horizontal bottom, vertical sides and an open top, said tank is between 2½ ft. and 3½ ft. in diameter and is from 4 ft. to 5 ft. in vertical extent, an elongate vertical radially outwardly opening gate opens at one side of the body, the gate is at least 18 inches and no greater than the diameter of the tank in lateral extent and is substantially coextensive with the vertical extent of the tank, a water container at least twice the volumetric extent of the tank with a side communicating with said gate opening, a volume of water filling the tank, gate and container, a plurality of nozzles at the sides of the tank spaced radially outward, circumferentially and vertically about the central vertical axis of the tank and directed substantially horizontally and radially inward, water recirculating means conducting water from the container and the tank and delivering water at high pressure to the nozzles, at least one nozzle occurs at a side of the tank within a quadrant about the axis of the tank in which at least a portion of the gate opening occurs, the nozzles function to direct jets of water into the volume of water in the tank to turbulate and increase the volume of water in the tank, the increased volume of turbulating water in the tank moves substantially freely through the gate opening and into the container to maintain the water level in the tank substantially constant.

8. The hydrotherapeutic massage structure set forth in claim 7 wherein the nozzles are water-air aspirator nozzles and the structure further includes air supply means to deliver air to the nozzles, said nozzles function to move air into the tank with the jets of water to aerate, lighten and further expand the volume of water in the tank.

9. The hydrotherapeutic massage structure set forth in claim 8 wherein the tank has an outwardly projecting substantially horizontal arm-rest about its open top.

10. The hydrotherapeutic massage structure set forth in claim 7 wherein the tank has an outwardly projecting substantially horizontal arm-rest about its open top.

11. The combination set forth in claim 7 wherein the tank has an outwardly projecting substantially horizontal arm-rest about its open top and an upwardly projecting weir about the outer primeter of the arm-rest.

* * * * *